US011359293B2

(12) United States Patent
Gullapalli et al.

(10) Patent No.: US 11,359,293 B2
(45) Date of Patent: Jun. 14, 2022

(54) SYSTEMS AND METHODS FOR MONITORING CATHODIC PROTECTION DEGRADATION

(71) Applicant: Rheem Manufacturing Company, Atlanta, GA (US)

(72) Inventors: Satya Kiran Gullapalli, Oxnard, CA (US); Jorge Miguel Gamboa Revilla, Oxnard, CA (US); Sergio Montalgo Salazar, Oxnard, CA (US)

(73) Assignee: Rheem Manufacturing Company, Atlanta, GA (US)

( * ) Notice: Subject to any disclaimer, the term of this patent is extended or adjusted under 35 U.S.C. 154(b) by 137 days.

(21) Appl. No.: 16/805,994

(22) Filed: Mar. 2, 2020

(65) Prior Publication Data

US 2021/0269926 A1 Sep. 2, 2021

(51) Int. Cl.

| | |
|---|---|
| ***C23F 13/22*** | (2006.01) |
| ***F24H 9/20*** | (2022.01) |
| ***G08B 25/01*** | (2006.01) |
| ***G08B 5/36*** | (2006.01) |
| ***G08B 21/20*** | (2006.01) |

(52) U.S. Cl.

CPC ..... *C23F 13/22* (2013.01); *F24H 9/2021* (2013.01); *G08B 5/36* (2013.01); *G08B 21/20* (2013.01); *G08B 25/016* (2013.01)

(58) Field of Classification Search

CPC ..... G08B 5/36; G08B 21/20; G08B 21/182; G08B 25/016; A61B 5/073; C02F 1/4602; C23F 13/005; C23F 13/04; C23F 13/06; C23F 13/10; C23F 13/18; C23F 13/22; F24H 1/0018; F24H 1/40; F24H 9/2021; F24H 9/45; G01N 17/02

USPC ..... 392/457

See application file for complete search history.

(56) References Cited

U.S. PATENT DOCUMENTS 10,895,566 B1 * 1/2021 Teepe ..... G01N 17/04
2004/0222084 A1 11/2004 Wigg et al.

(Continued)

FOREIGN PATENT DOCUMENTS

| | | | |
|---|---|---|---|
| CN | 110023690 | A | 7/2019 |
| CN | 110164066 | A | 8/2019 |
| JP | 63123998 | S | 5/1988 |

OTHER PUBLICATIONS

International Search Report and Written Opinion of PCT Application No. PCT/US2021/020215 dated Jun. 3, 2021.

*Primary Examiner* — Stephen R Burgdorf

(74) *Attorney, Agent, or Firm* — Eversheds Sutherland (US) LLP

(57) ABSTRACT

Systems and methods for monitoring anodic protection are disclosed. The system can include a sacrificial anode having an anode body, at least one cavity within the anode body, a conductor disposed within the at least one cavity, and electronic circuitry in communication with the conductor. The sacrificial anode can be electrically connected to a component or structure that is subject to galvanic corrosion. The cavity can be positioned such that as the anode degrades to a certain point, the conductor will contact water. In response, an alert can be provided to inform a user that the sacrificial anode needs replacement. The alert can be provided by activating a light, siren, or other device. The alert can also be sent to a mobile device or website.

20 Claims, 7 Drawing Sheets

(56) References Cited

U.S. PATENT DOCUMENTS

| | | | | |
|---|---|---|---|---|
| 2014/0016995 | A1* | 1/2014 | Wilson | F16L 13/007 403/272 |
| 2014/0216945 | A1* | 8/2014 | Farris | C23F 13/005 205/726 |
| 2019/0360108 | A1* | 11/2019 | Oshaug Aasen | C23F 13/22 |
| 2020/0032536 | A1* | 1/2020 | Corn | A61H 33/063 |
| 2021/0033346 | A1* | 2/2021 | Yamada | F25B 39/00 |
| 2021/0340679 | A1* | 11/2021 | Glass | F28F 19/004 |
| 2021/0356385 | A1* | 11/2021 | Shah | F24H 9/45 |

* cited by examiner

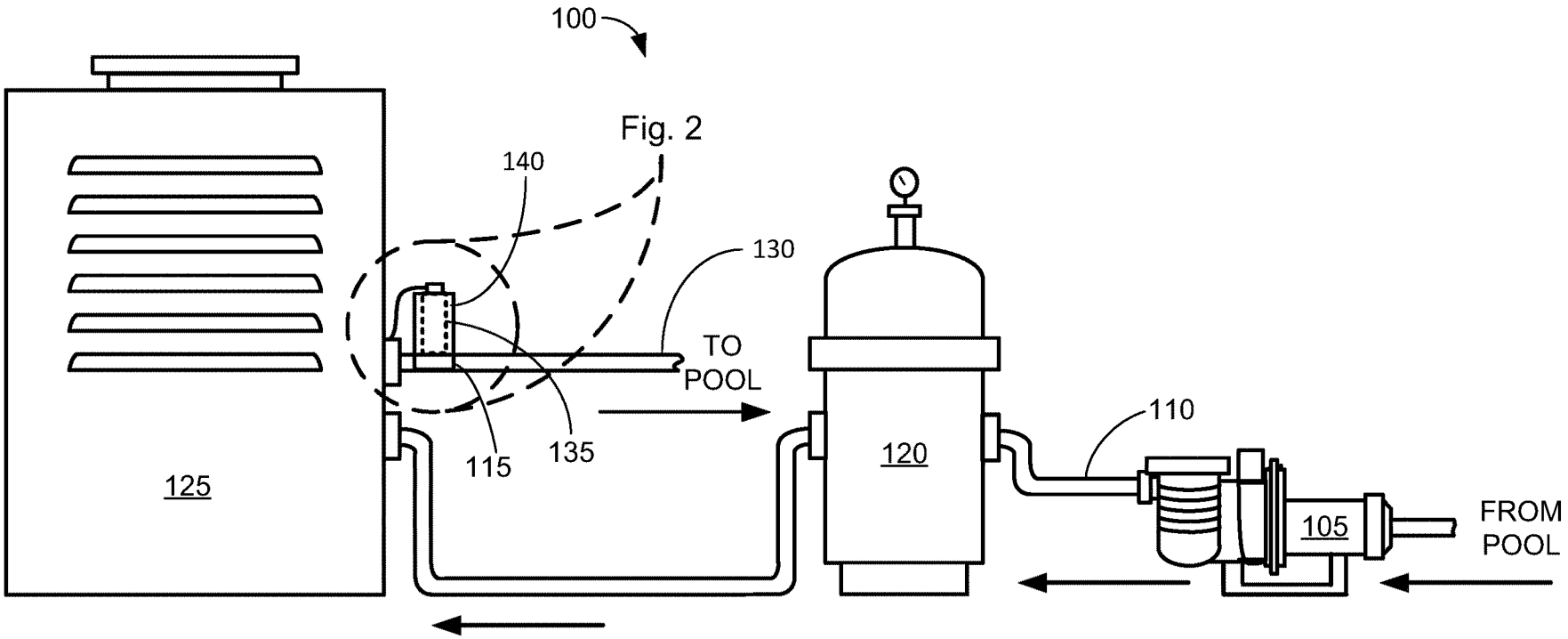
*Fig. 1* *Prior Art*

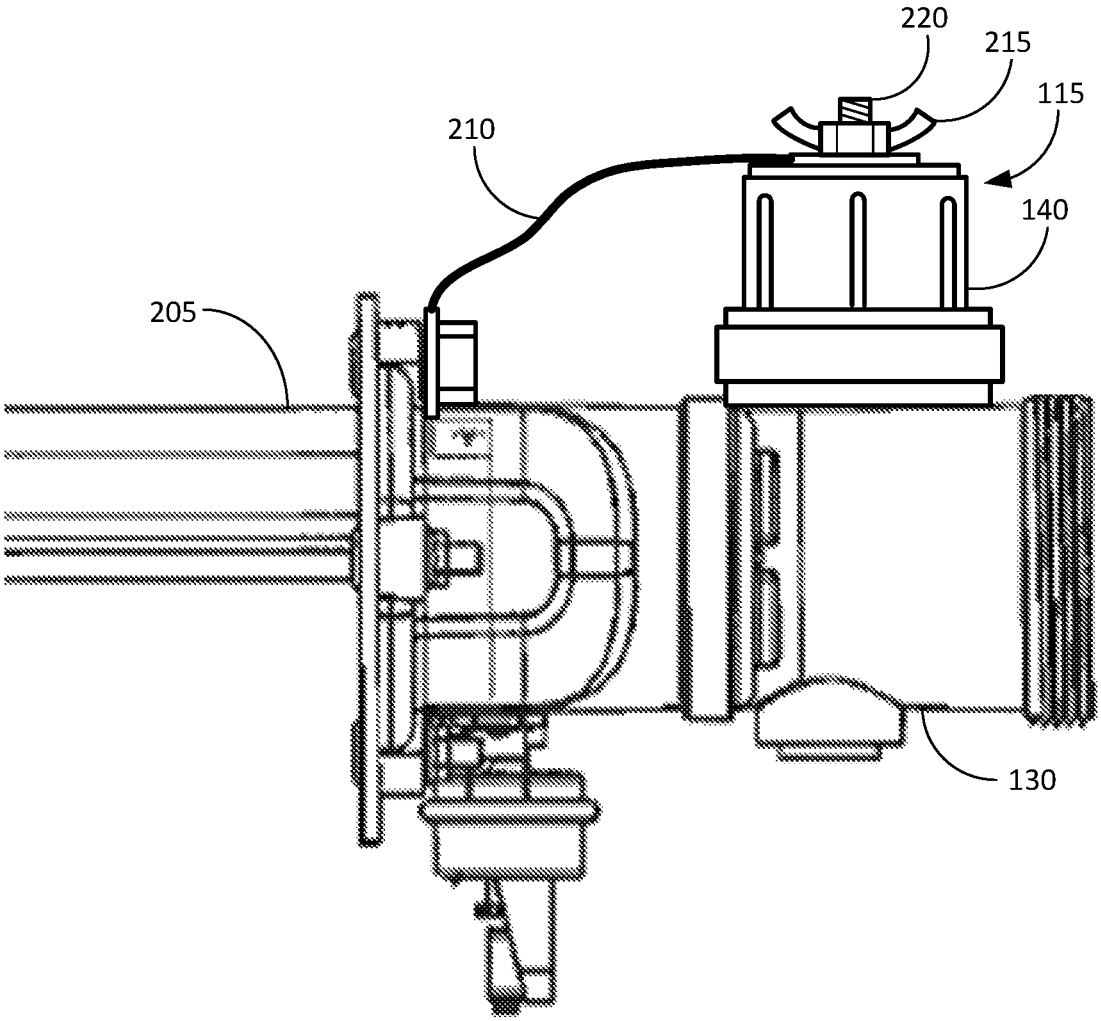
*Fig. 2* *Prior Art*

SYSTEMS AND METHODS FOR MONITORING CATHODIC PROTECTION DEGRADATION

TECHNICAL FIELD

Examples of the present disclosure related generally to anode protection systems for water heating devices, and more specifically to systems and methods for monitoring and maintaining cathodic protection in water heating devices.

BACKGROUND

Water heating devices such as pool and hot tub heaters, boilers, and residential and commercial water heaters generally contain a heat exchanger that transfers heat from a heat source (e.g., a gas burner or electric heating element) to the water. The heat can be generated by any of a variety of sources including combustion, mains electricity, solar heat, or solar power. The heat exchanger and associated components that are in contact with the water are often made from metal that corrodes in response to exposure to the water.

One solution for protecting metallic surfaces from corrosion due to water exposure is the use of a sacrificial anode. The anode is typically made from a material, such as zinc, magnesium, or aluminum, that corrodes more readily than the components of the water heating device. The anode can have more negative reduction potential (more positive electrochemical potential) than the heat exchanger, for example, which causes the anode to corrode instead of the components of the heat exchanger, thereby protecting the heat exchanger from corrosion.

FIG. 1 depicts an example of a prior art water heating system 100 for a pool. The system 100 can include a pump 105 that draws water from a pool, hot tub, or other source and directs the water along an inlet pipe 110 and through a filter 120, and ultimately to a heater 125. The arrows in FIG. 1 show the general direction of the flow of the water. After the water is heated, it is returned to the pool via a return pipe 130. The return pipe 130 (or the inlet pipe 110) can also include an anode assembly 115, which includes a sacrificial anode 135 that interacts with the water as it flows through the system 100. The anode assembly 115 can also include a housing 140 in which the sacrificial anode 135 is enclosed.

FIG. 2 depicts an example in which the anode assembly 115 is installed on the return pipe 130. As shown, the return pipe 130 can be at the outlet of a heat exchanger 205, which heats the water. The anode assembly 115 can be attached to the return pipe 130 such that the sacrificial anode 135 is in communication with the water. The sacrificial anode 135 can also be in electrical communication with the return pipe 130 and/or the heat exchanger 205. This can be done with a suitably sized bonding wire 210, for example, or in any other suitable manner. The bonding wire 210, in turn, can be in electrical communication with the sacrificial anode 135 via, for example, a nut 215 and/or bolt 220. For convenience of manufacturing and installation, the bolt 220 is often cast into the sacrificial anode 135, such that the bolt 220 and the sacrificial anode 135 are integral and a portion of the bolt 220 protrudes out of the sacrificial anode 135.

As water passes through the pipes 110, 130 and the heat exchanger 205, any electrical potential created by the interaction causes the anode 135 to corrode instead of the pipes 110, 130 and the heat exchanger 205. Unfortunately, other than manually checking the anode 135, there is currently no way to determine when the anode 135 should be replaced.

Indeed, if the housing 140 of the anode assembly 115 is opaque (e.g., metal or opaque plastic), then the anode assembly 115 may need to be disassembled to inspect the anode 135. Even if the housing of the anode assembly 115 is clear, the user still must physically check the anode 135 and replace, as necessary.

In view of these shortcomings, there is a need for systems and methods for monitoring and maintaining cathodic protection in water heating devices.

SUMMARY

These and other aspects, objects, features, and embodiments will be apparent from the following description and the appended claims.

An example of the present invention can provide a sacrificial anode system comprising an anode body, a cavity within the anode body, a conductor (or water detection mechanism) disposed within the cavity, and electronic circuitry in communication with the conductor. As will be appreciated, degradation of the anode permits water to enter the cavity such that the conductor/water detection mechanism comes into electrical contact with the water and completes a circuit such. The circuitry can then provide an indication of the overall amount of anode degradation based on the positioning and depth of the cavity within the sacrificial anode. For example, a sacrificial anode may have two cavities, one being positioned at a point that would indicate roughly 50% degradation of the anode and another positioned to indicate roughly 75% degradation.

The sacrificial anode can be a passive anode. The sacrificial anode can further include an anode housing, wherein the anode body is disposed in the anode housing. The anode housing can include an attachment mechanism configured to connect to a plumbing system. The sacrificial anode can further include a second cavity within the anode body and a second conductor disposed within the second cavity, wherein the electronic circuitry can be in communication with the second conductor.

The electronic circuitry can include an alert indicator in communication with a power source and with the conductor. The alert indicator can include a light emitting diode (LED) assembly in communication with the conductor. The electronic circuitry can include a timer circuit configured to detect time of operation. The electronic circuitry can further include a controller configured to detect an electrical signal flowing along the conductor, generate an alert message, and transmit the alert message to a user device.

A further example of the present invention can provide water heating system comprising a combustion chamber, an exhaust vent, and a heat exchanger. The heat exchanger can include a header and a series of tubes through which water passes. The heat exchanger can be configured to transfer heat from combustion gases originating in the combustion chamber to the water passing through the series of tubes and can include an inlet, an outlet, and a sacrificial anode assembly directly attached to the header. The anode assembly can include an anode body, a cavity within the anode body, a conductor disposed within the cavity, and electronic circuitry in communication with the conductor.

The sacrificial anode of the water heating system can be a passive anode. The sacrificial anode can further include an anode housing, wherein the anode body is disposed in the anode housing. The anode housing can include an attachment mechanism configured to connect to a portion of the header. The electronic circuitry can include an alert indicator in communication with a power source and with the conductor. The alert indicator can include a light emitting diode (LED) assembly in communication with the conductor. The electronic circuitry can include a timer circuit configured to detect time of operation.

Yet another example of the present invention can provide a sacrificial anode assembly comprising anode housing configured to attach to a portion of a water heating system and comprising a housing body and a housing cover, an anode body disposed within the housing body, a cavity within the anode body, a water detection mechanism disposed within the cavity, and electronic circuitry in communication with the conductor. At least a portion of the electronic circuitry can be disposed within the housing cover.

The electronic circuitry of the sacrificial anode assembly can include a controller configured to detect a signal from the water detection mechanism, determine a degradation status of the anode body, generate an alert message indicating the degradation status, and transmit the alert message to a user device. Further, the electronic circuitry of the sacrificial anode assembly can include a controller configured to detect a signal from the water detection mechanism, determine a degradation status of the anode body, determine a corrective action based on the degradation status, generate a command signal including instructions for instituting the corrective action, and transmit the command signal a device associated with the water heating system.

These and other aspects, objects, features, and embodiments will be apparent from the following description and the appended claims.

BRIEF DESCRIPTION OF THE DRAWINGS

Reference will now be made to the accompanying drawings, which are not necessarily drawn to scale, and which are incorporated into, and constitute a portion of, this disclosure. The drawings illustrate various implementations and aspects of the disclosed technology and, together with the description, serve to explain the principles of the disclosed technology. In the drawings:

FIG. 1 is an example of a prior art water heating system for a pool or hot tub with a sacrificial anode.

FIG. 2 is a detailed view of the sacrificial anode of FIG. 1.

DETAILED DESCRIPTION

Figure 3A:
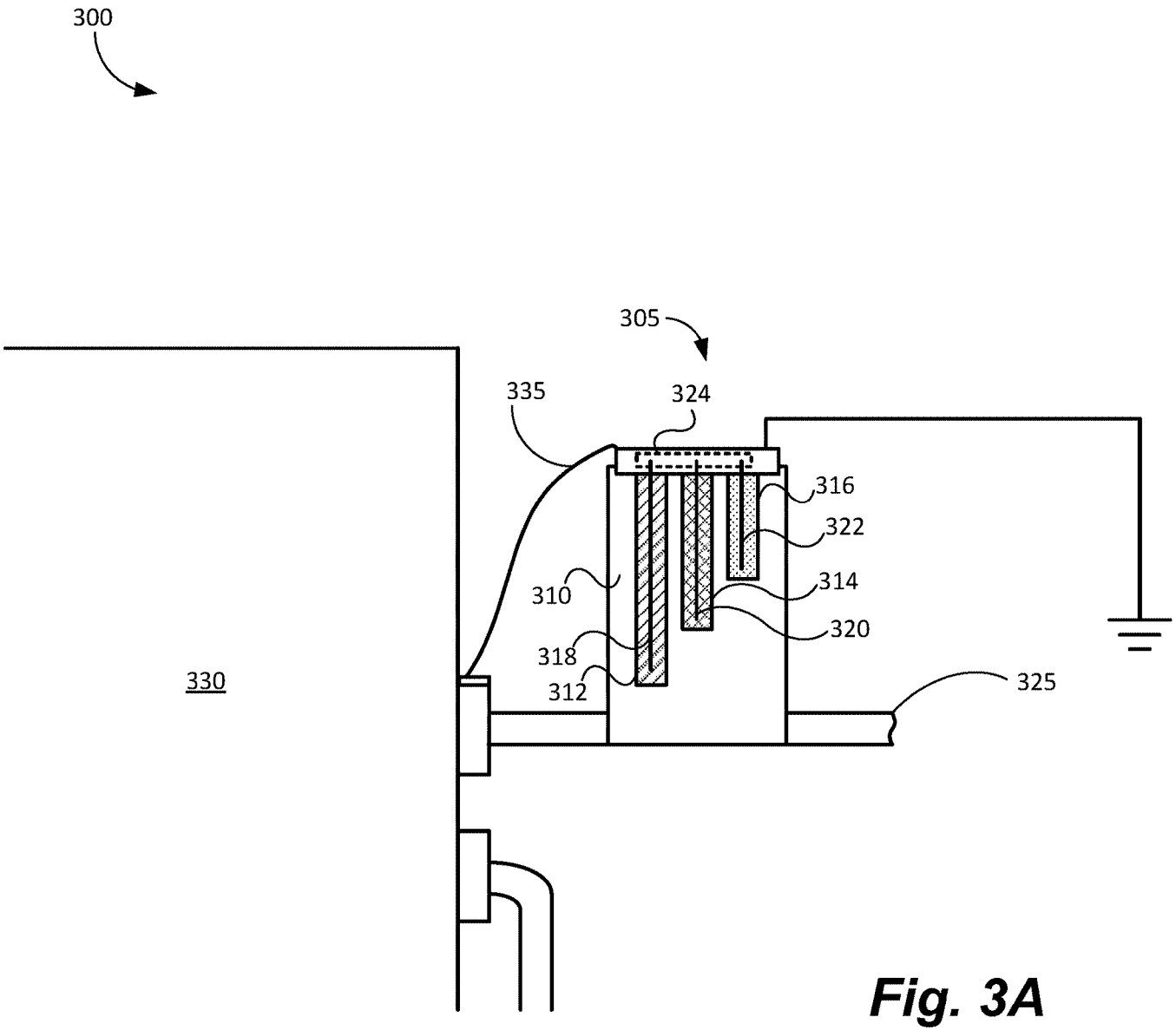
FIG. 3A is a schematic of system for anode monitoring in water heating devices, in accordance with some examples of the present disclosure.

Examples of the present disclosure include systems and methods for monitoring anodic protection on devices subject to galvanic corrosion. The disclosed technology includes systems that can include a sacrificial anode in physical communication with a component or structure that is subject to galvanic corrosion. The sacrificial anode can also be electrically connected to the component or structure. When a voltage potential exists between the structure and the water, which would normally cause the component or structure to corrode, the sacrificial anode can corrode instead of the component of structure. This prevents or reduces the galvanic corrosion of the component or structure.

The sacrificial anode can include electronic circuitry and a water detection mechanism (e.g., wire, capillary rod, probe, conductor of any kind, etc.) as part of the anode structure. To monitor the condition of the sacrificial anode, and thus the protection level or degradation status provided thereby, the water detection can identify the remaining protection level of the anode (e.g., an approximation of the remaining amount or portion of the sacrificial anode) based on water detection information associated with the anode degradation.

As explained above, degradation of the anode permits water to enter the cavity such that the conductor/water detection mechanism comes into electrical contact with the water and completes a circuit such. The circuitry can then provide an indication of the overall amount of anode degradation based on the positioning and depth of the cavity within the sacrificial anode. For example, a sacrificial anode can have two cavities: a first cavity having a first depth within the anode and a second cavity having a second depth that is less than the first depth. As the anode material degrades, the first cavity can become exposed to the environment, which can permit water to contact the conductor within the first cavity. The depth of the first cavity can be such that water contacting the conductor in the first cavity can indicate roughly 50% degradation (or some other predetermined amount) of the anode has occurred. Likewise, as the anode material continues to degrade, the second cavity can become exposed to the environment, which can permit water to contact the conductor within the second cavity. The depth of the second cavity can be such that water contacting the conductor in the second cavity can indicate roughly 75% degradation (or some other predetermined amount).

When the protection level drops below a predetermined level, an alert can be provided to inform a user that the sacrificial anode needs replacement. For example, a conductor can be inserted into a cavity of the sacrificial anode. As the anode degrades, the cavity, and thus the conductor, will become exposed to the water, which will act as a circuit closure to ground. The electronic circuitry can sense the circuit close and generate an alert to inform a user about the anode status.

For ease of explanation, the system is described herein with reference to a pool heater. One of skill in the art will recognize, however, that the system can be applied to a variety of water heating devices including, but not limited to, hot tub heaters, boilers, and commercial and residential water heaters. Indeed, the system can be used anytime a sacrificial anode is used to protect metal components (e.g., boats, docks, bridges, underwater cables, plumbing, oil derricks, etc.).

Examples of the disclosed technology will be described more fully below with reference to the accompanying drawings. Water heating devices, the monitoring system, and the specific layout of the system, however, can be embodied in many different forms. As a result, this disclosure should not be construed as limiting; rather, these examples are provided so that this disclosure will be thorough and complete, and will fully convey the scope of the system to those of ordinary skill in the art. Like, but not necessarily the same, elements (sometimes referred to herein as components) in the various figures are denoted by like reference numerals for consistency.

Herein, the use of terms such as "having," "has," "including," or "includes" are open-ended and are intended to have the same meaning as terms such as "comprising" or "comprises" and not preclude the presence of other structure, material, or acts. Similarly, though the use of terms such as "can" or "may" are intended to be open-ended and to reflect that structure, material, or acts are not necessary, the failure to use such terms is not intended to reflect that structure, material, or acts are essential. To the extent that structure, material, or acts are presently considered to be essential, they are identified as such.

By "comprising" or "containing" or "including" is meant that at least the named compound, element, particle, or method step is present in the composition or article or method, but does not exclude the presence of other compounds, materials, particles, method steps, even if the other such compounds, material, particles, method steps have the same function as what is named.

It is also to be understood that the mention of one or more method steps does not preclude the presence of additional method steps or intervening method steps between those steps expressly identified.

The components described hereinafter as making up various elements of the disclosure are intended to be illustrative and not restrictive. Many suitable components that would perform the same or similar functions as the components described herein are intended to be embraced within the scope of the disclosure. Such other components not described herein can include, but are not limited to, for example, similar components that are developed after development of the presently disclosed subject matter.

Reference will now be made in detail to examples of the disclosed technology, such as those illustrated in the accompanying drawings. Wherever convenient, the same references numbers will be used throughout the drawings to refer to the same or like parts.

FIG. 3A depicts a sacrificial anode system 300, in accordance with some examples of the present disclosure. As shown, the system 300 can include a sacrificial anode assembly 305, with a sacrificial anode 310 having one or more cavities 312, 314, 316. If multiple cavities 312, 314, 316 are included, each cavity can have a different size (e.g., length), and each cavity can correspond to a different protection level, as described more fully below. The anode assembly 305 can be installed such that the anode 310 is in physical contact with the water flowing through the system 300. In this case, the anode assembly 305 can be mounted to an outlet pipe 325 on a water heater 330. Alternatively or in addition, an anode assembly 305 could be similarly mounted on an inlet pipe. As will be appreciated, the water heater 330 as used herein could alternatively be any device that has metallic components in contact with water for which corrosion protection is desired.

As further depicted, the system 300 can include one or more water detection mechanisms 318, 320, 322 disposed within each of the one or more cavities 312, 314, 316 and in electronic communication with electronic circuitry 324. The sacrificial anode 310 can be in electrical communication with the water heater 330 via a bonding wire 335 or another suitable conductor. When an electrical potential exists between the water and the components of the water heater 330, the sacrificial anode 310 anode corrodes, so that the anode material is consumed instead of the metal components in the water heater 330.

To monitor the condition of the sacrificial anode 310, and thus the protection level provided thereby, the electronic circuitry 324 in conjunction with the one or more water detection mechanisms 318, 320, 322 can identify the remaining protection level of the anode based on sensing or detecting information associated with the anode degradation. When the protection level drops below a predetermined level, an alert can be provided to inform a user that the sacrificial anode needs replacement. For example, a water detection mechanisms 318, 320, 322 (e.g., a conductor) can be inserted into a cavity 32, 314, 316 of the sacrificial anode 310. As explained above, each cavity can have a different size (e.g., length), and the water detection mechanism for each respective cavity can extend throughout the entire length or substantially the entire length of the respective cavity. As the anode degrades 310, the cavity 312, 314, 316, and thus water detection mechanisms 318, 320, 322, will become exposed to the water, which will act as a circuit closure to ground. The electronic circuitry 324 can sense the circuit close and generate an alert to inform a user about the degradation status of the anode 310. As a more specific example, a first cavity can have a first length (e.g., a length that is less than a length of the anode 310) a second cavity can have a second length that is less than the first length. As the anode 310 degrades, the first cavity (and thus, the first water detection mechanism) will typically come into contact with water from the environment before the second cavity (and second water detection mechanism) because the first cavity is longer, and thus closer to the outer surface of the anode 310 when new, as compared to the second cavity. Accordingly, the first cavity and first water detection mechanism can be associated with a first level or amount of degradation (e.g., 10% degraded) or a first protection level (e.g., 90% of the life or mass of the anode 310 remains), and the second cavity and second water detection mechanism can be associated with a second level or amount of degradation (e.g., 30% degraded) or a second protection level (e.g., 70% of the life or mass of the anode 310 remains).

The number and position of both the one or more water detection mechanisms 318, 320, 322 and the one or more cavities 312, 314, 316 of the sacrificial anode 310 can vary depending on desired monitoring characteristics. For example, sacrificial anode system 300 can include two cavities at varying depths within the anode 310 each having a water detection mechanism in order to measure (1) a midlife point of the anode 310 (e.g., when roughly half of the anode has degraded) and (2) a replacement point when it is time for the user to replace the anode 310. In such an example, the cavity and water detection mechanism can be configured to determine when the midlife point has been reached can extend to a deeper depth within the anode 310 than the cavity and water detection mechanism can be configured to determine when the replacement point has been reached. As will be appreciated, the number of cavities can be increased or decreased based on the desired granularity of the monitoring. For example, more cavities (e.g., 3, 4, 5, 6, or more cavities) can be used to provide more specific estimates of anode degradation as opposed to an anode with one or two cavities.

Figure 3C:
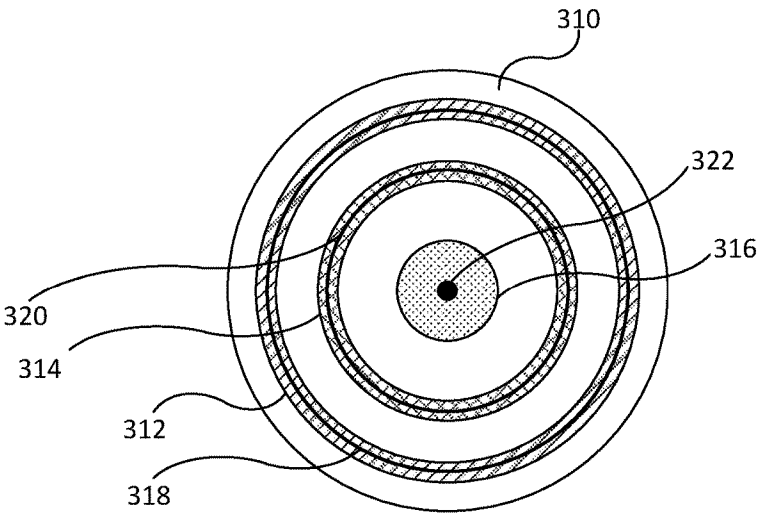
FIG. 3C is top down view of a cutaway of the anode assembly depicted in FIG. 3B, in accordance with some examples of the present disclosure.
Figure 3B:
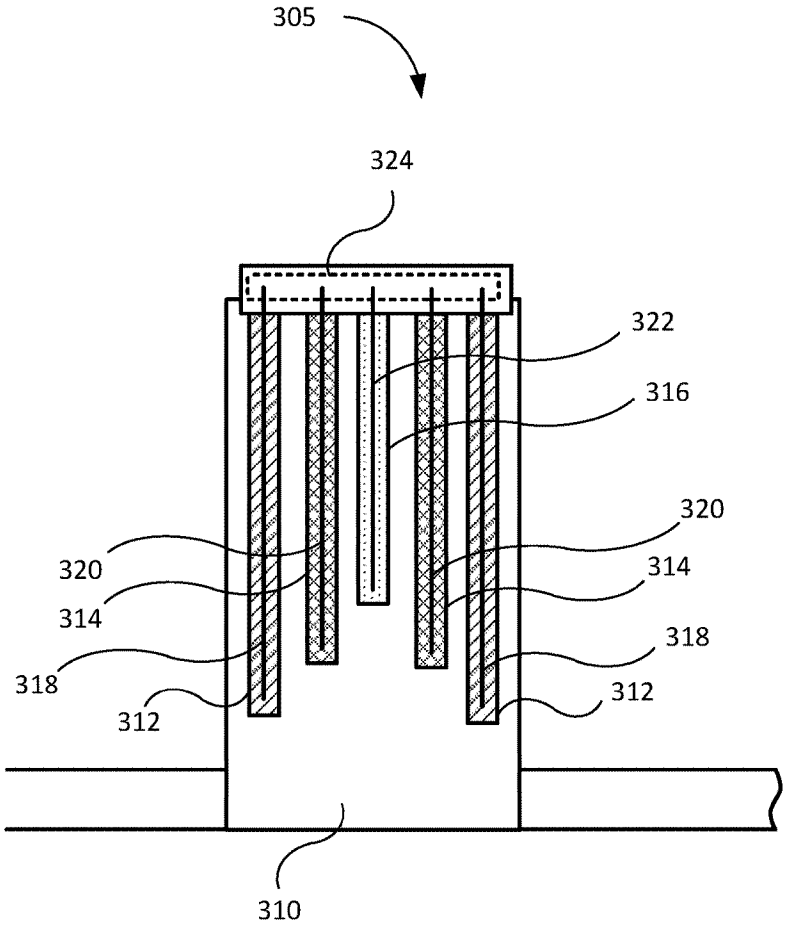
FIG. 3B is a schematic of an anode assembly for use in anode monitoring in water heating devices, in accordance with some examples of the present disclosure.

FIGS. 3B and 3C depict an additional example of a sacrificial anode system 300. As will be appreciated the degradation of the anode may not be uniform. For example, some anodes may degrade faster around edges than along a middle portion or vice versa. To overcome any non-uniform degradation, the one or more cavities 312, 314, 316 can be shaped in various ways. For example, the anode 310 can contain one or more cavities, such as cavities 312 and 314 as depicted if FIGS. 3B and 3C, shaped as circles or cylinders (e.g., concentric cylinders) of varying depths in order to account for the three-dimensional shape of the anode. As further depicted, anode 310 can contain both concentric shaped cavities (e.g., 312 and 314) and previously discussed cylindrical cavities (e.g., 316). As will be appreciated, the number and shape of the cavities can vary.

As previously mentioned, when the protection level drops below a predetermined level, the electronic circuitry 324 can generate an alert to inform a user that the sacrificial anode 310 needs replacement. Electronic circuitry 324 can include one or more electrical components configured to receive and process information regarding the degradation status of the anode 310 and to communicate the information with other devices, such as a user device and/or other devices associated with water heater system 100, such as burners, pumps, heat pumps, hydronic units, valves, and the like. For example, the electronic circuitry 324 can include one or more of an input/output ("I/O") device, a memory, a controller, a processor, a communication module configured to communicate wirelessly using any useful method or technology or via wired communication, and a display. The electronic circuitry 324 can be integrated into the sacrificial anode assembly 305, as described above. Alternatively, or additionally, the electronic circuitry 324 can be included in a separate and distinct modular connection to the sacrificial anode assembly 305. That is to say that a user can easily attach and/or detach the electronic circuitry 324 to the sacrificial anode assembly 305.

Further, when the protection level drops below a predetermined level, the electronic circuitry 324 can output one or more corrective actions to other devices associated with water heater system 100. The corrective actions can be, for example, an emergency shutdown of all or a portion of the water heater system 100, and/or transmitting an alert to a user of the water heater system 100 that the sacrificial anode 310 is depleted. By way of another example, if the electronic circuitry 324 determines that the sacrificial anode 310 is depleted, the controller can utilize network connectivity to schedule a maintenance call with the manufacturer to replace the sacrificial anode 310 and/or automatically place an order for a replacement sacrificial anode 310. Corrective actions can further include such actions as: altering a flow rate (e.g., adjusting performance of one or more pumps), altering a temperature (e.g., adjusting performance of a burner), altering water chemistry (e.g., by adjusting chemical levels), and the like.

Figure 4:
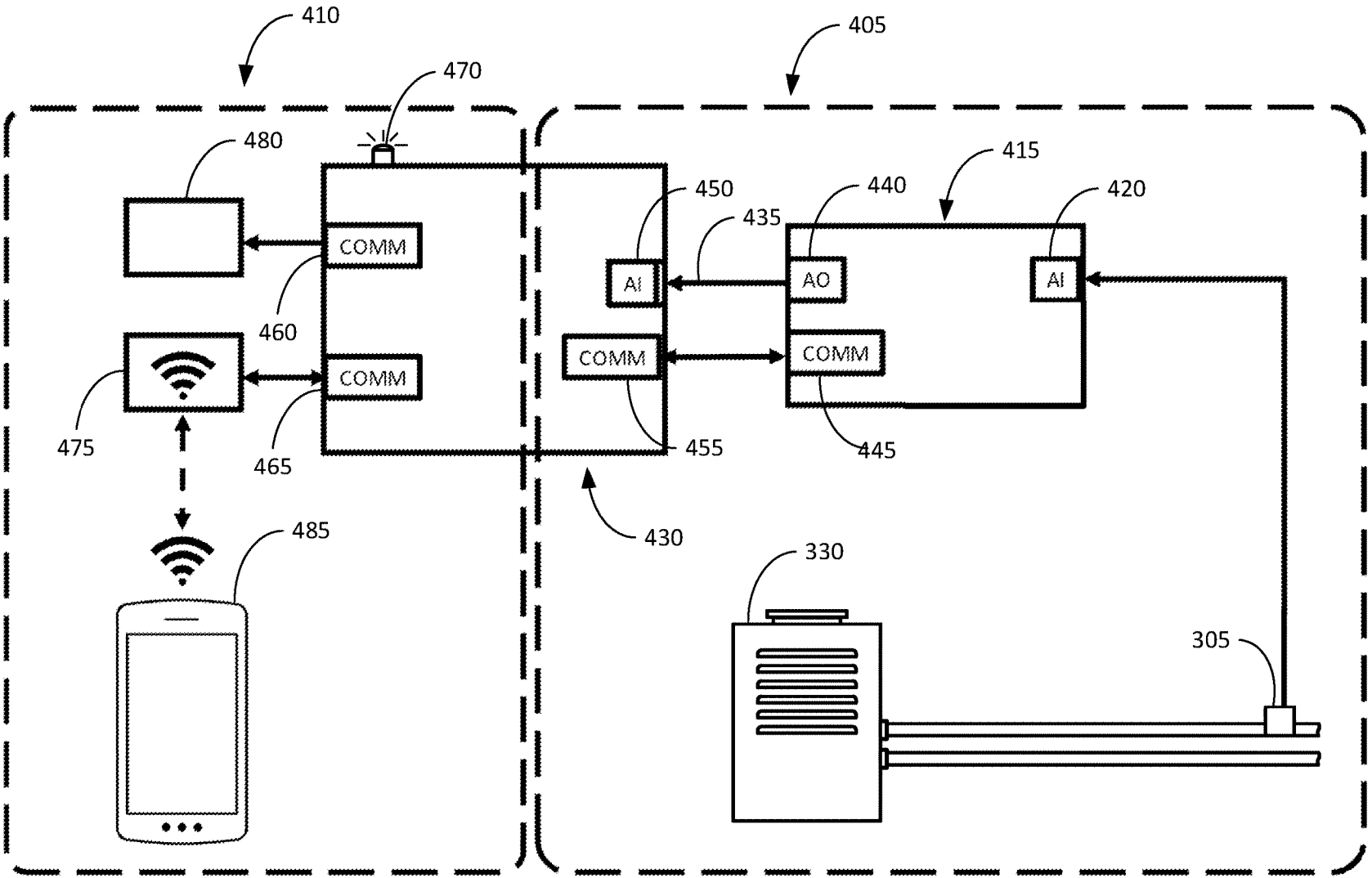
FIG. 4 is a schematic view of an example controller for use with a sacrificial anode, in accordance with some examples of the present disclosure.

FIG. 4 depicts a monitoring and reporting system 400 for use in conjunction with a system similar to the system 300 of FIG. 3. As shown, the system 400 can comprise a monitoring system 405 and a communications system 410. One or more components of monitoring system 405 and/or communications system 410 can be included in electronic circuitry 324.

The monitoring system 405 can comprise an anode controller 415, which can be a controller, in communication with the anode 305. The anode controller 415 can also be in communication with a unit controller 430. The anode controller 415 can identify the remaining protection level of the anode based on water detection information associated with the anode degradation. For example, the anode controller 415 can receiving water detection information from one or more sensors within the anode 305 (e.g., the one or more water detection mechanisms 318, 320, 322), and determine, based on the water detection information, an anode status. When the determined anode status reaches various milestones (e.g., percentages of consumption), the monitoring system 405 can send a signal, or protection measurement signal 435, to the communications system 410 to provide an alert to the user.

The anode controller 415 can also include one or more ports. The anode controller 415 can include, for example, a first port 440 to carry the protection measurement signal 435 and a second port 445 for communications with the unit controller 430. The second port 445 can comprise a serial interface, for example, to enable bidirectional communications between the controllers 415, 430. In some examples, the first port 440 can provide raw data, for example, while the second port 445 can provide uni- or bidirectional communications with the unit controller 430 (e.g., via serial, USB, Wi-Fi, Bluetooth®, etc.) In some examples, the second port 445 can receive commands, software and firmware updates, and other data for the anode controller 415 from the unit controller 430. In other examples, the second port 445 can include a direct connection to the Internet, an intranet, or other network to enable the anode controller 415 to receive data directly.

The unit controller 430 can include one or more communications ports, processors, memory, etc. to enable the unit controller 430 to monitor the condition of the sacrificial anode 310 and to periodically provide updates to a user or network. Thus, the unit controller 430 can include a third port 450 in communications with the first port 440 of the anode controller 415 and a fourth port 455 in communication with the second port 445 on the anode controller 415. The ports 450, 455 can each comprise inputs, outputs, or input/outputs. As mentioned above, in some examples, the third port 450 can comprise a dedicated port to receive the protection measurement signal 435 (e.g., a raw data, a percentage of life left, etc.) and the fourth port 455 can comprise a uni- or bidirectional communications port with the anode controller 415. Of course, the configuration shown is somewhat arbitrary and other configurations and inputs/outputs could be used.

The unit controller 430 can also include one or more communications ports 460, 465. A first communications port 460 can be in communication with a network adapter 480, for example, to enable the unit controller 430 to communicate, via a wired modem or transceiver, with the Internet, an intranet, or other wired network. This can enable a user to access a website, for example, on which the unit controller 430 provides the current status of the sacrificial anode 310 at any given time. A user could log into a portal, for example, to connect with the unit controller 430 and/or the anode controller 415 and receive the percentage of the sacrificial anode 310 that remains or has been used, the number of days or weeks the sacrificial anode 310 is estimated to last, the last time the sacrificial anode 310 was changed, etc.

In some examples, the unit controller 430 can also comprise an alert 470 such as a light (shown), siren, speaker, or other alert to inform the user when the sacrificial anode 310 has been sufficiently depleted. In some examples, such as when the alert 470 is a light, the light can be activated (turned on) by the unit controller 430 when the sacrificial anode 310 reaches 90% depletion (10% remaining life), for example, and then start flashing when the sacrificial anode 310 reaches 95% depletion. In some examples, the alert 470 can be located on, or near, the water heater 330, but can be visible to an observer (e.g., located on the outside of a control panel). In other examples, the alert 470 can be remotely mounted to be more accessible. The alert 470 could be placed on the door to a utility room, for example, or anywhere that is convenient to alert the user to needed maintenance.

The alert 470 need only provide enough notice to enable the user to act in a reasonable amount of time. In other words, because the sacrificial anode 310 is generally designed to be depleted relatively slowly, the alert 470 can initially beep or flash slowly and subsequently increase in intensity as sacrificial anode 310 life approaches zero. If the alert 470 is a siren, for example, it can start out beeping periodically (like a smoke detector with low batteries) when the sacrificial anode 310 has about 20% life remaining and gradually transition to a fast beep, constant noise, or increase in volume as the sacrificial anode 310 is depleted.

In some examples, the second communications port 465 can be in communication with a wireless network adapter 475—e.g., a Wi-Fi, Bluetooth®, cellular, etc. adapter—to enable the unit controller 430 to communicate with a wireless router, cell tower, microcell, etc. to connect to the Internet, an intranet, or other network. In this configuration, a user can log into a portal on their user device 485 (shown), tablet, laptop, desktop, or other device to connect with the unit controller 430 and/or the anode controller 415 and receive the percentage of the sacrificial anode 310 that remains or has been used, the number of days or weeks the sacrificial anode 310 is estimated to last, the last time the sacrificial anode 310 was changed, etc.

In some examples, the unit controller 430 and/or the anode controller 415 can provide an alert to the user when the sacrificial anode 310 reaches a predetermined level. When there is only 10% of the sacrificial anode 310 left, for example, the unit controller 430 and/or the anode controller 415 can send an alert to the user device 485, send an email to the user via one of the aforementioned portals, and/or to on the alert 470. As mentioned above, the alert 470 can increase in intensity as the sacrificial anode 310 approaches zero life. Similarly, e-mail, SMS, or other messages can also be sent to the user device 485 with increasing frequency and/or urgency as the sacrificial anode 310 approaches zero life.

And, although shown in close proximity, it is possible that the anode controller 415 and/or unit controller 430 can be located remotely from one another and from the water heater 330. In some examples, the anode controller 415 can be located near the water heater 330, for example, and directly connected to the anode 310. Similarly, the unit controller 430 can be located in a control panel or an electrical box near the water heater 330. In other examples, the anode controller 415 can be located near the water heater 330 but connected via a wired or wireless connection to a remote unit controller 430. This can enable the anode controller 415 to be located in a pool house or utility room, for example, and the unit controller 430 to be located in a bedroom or kitchen for easy access. Of course, with modern electronics, the anode controller 415 and the unit controller 430 could be located almost anywhere and connected via a wired or wireless connection to the anode 310.

Figure 5:
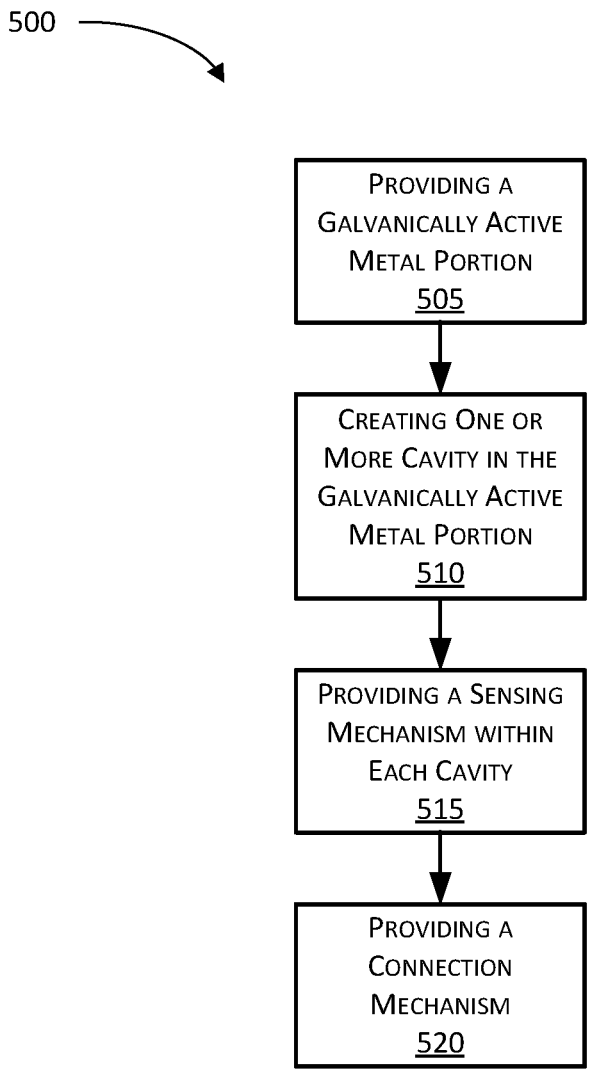
FIG. 5 is a flowchart depicting an example of a method of manufacturing a sacrificial anode, in accordance with some examples of the present disclosure.

FIG. 5 is a flowchart depicting an example of a method 500 for manufacturing a sacrificial anode, in accordance with some examples of the present disclosure. As depicted, the method 500 begins at 510 with providing a galvanically active metal portion (e.g., anode 310). For example, a rod or other shape can be formed by extruding a metal alloy. As will be appreciated, other process such as forging, rolling, and the like can also be used. Examples of suitable metals can include, but are not limited to, zinc, aluminum, magnesium, and/or some combination or alloy thereof.

At 510, one or more cavities 312, 314, 316 are created or formed in the galvanically active metal portion. The one or more cavities 312, 314, 316 can be formed during the formation of the galvanically active metal portion. Additionally, the one or more cavities 312, 314, 316 can be created or added to an already formed galvanically active metal portion. As will be appreciated, the one or more cavities 312, 314, 316 can be retrofitted into a preexisting passive anode by various processes, such as, for example, drilling holes or other similar processes. As previously discussed, the number of cavities can be increased or decreased based on the desired accuracy of the monitoring. For example, more cavities (e.g., 3, 4, 5, 6, or more cavities) can be used when attempting to get a more accurate understanding of the anode degradation.

Further, the one or more cavities 312, 314, 316 can be shaped in various ways. For example, an anode 310 can contain one or more cavities 312, 314, 316 shaped as concentric circles of varying depths in order to account for the three-dimensional shape of the anode. As another example the one or more cavities 312, 314, 316 can be shaped in a manner similar to the overall shape of the anode 310 (e.g., a square anode can have various square cavities).

At 515, a water detection mechanisms 318, 320, 322 can be provided within each of the one or more cavities 312, 314, 316. As previously discussed, the water detection mechanisms 318, 320, 322 can be any wire, capillary rod, probe, or conductor of any kind. The water detection mechanisms 318, 320, 322 can be disposed within the one or more cavities 312, 314, 316. Further, the water detection mechanisms 318, 320, 322 can also be shaped in various ways. For example, the water detection mechanisms 318, 320, 322 can be shaped similar to and sized smaller than the one or more cavities 312, 314, 316.

At 520, a connection mechanism can be provided or formed in the galvanically active metal portion. For example, a support shaft can extend through the sacrificial anode 310 (e.g., axially extend through the center of the sacrificial anode 120) through which a connection mechanism can be inserted. The support shaft can extend from one end of the sacrificial anode 310 and/or can have an attachment device, mechanism, or design such that the sacrificial anode 310 can be attached (e.g., via the end of the support shaft) to an object. Further, the sacrificial anode can be provided as part of a system (e.g., system 300) which includes a housing, which can be configured to attach the anode 310 to a system, such as water heating system 100.

Figure 6:
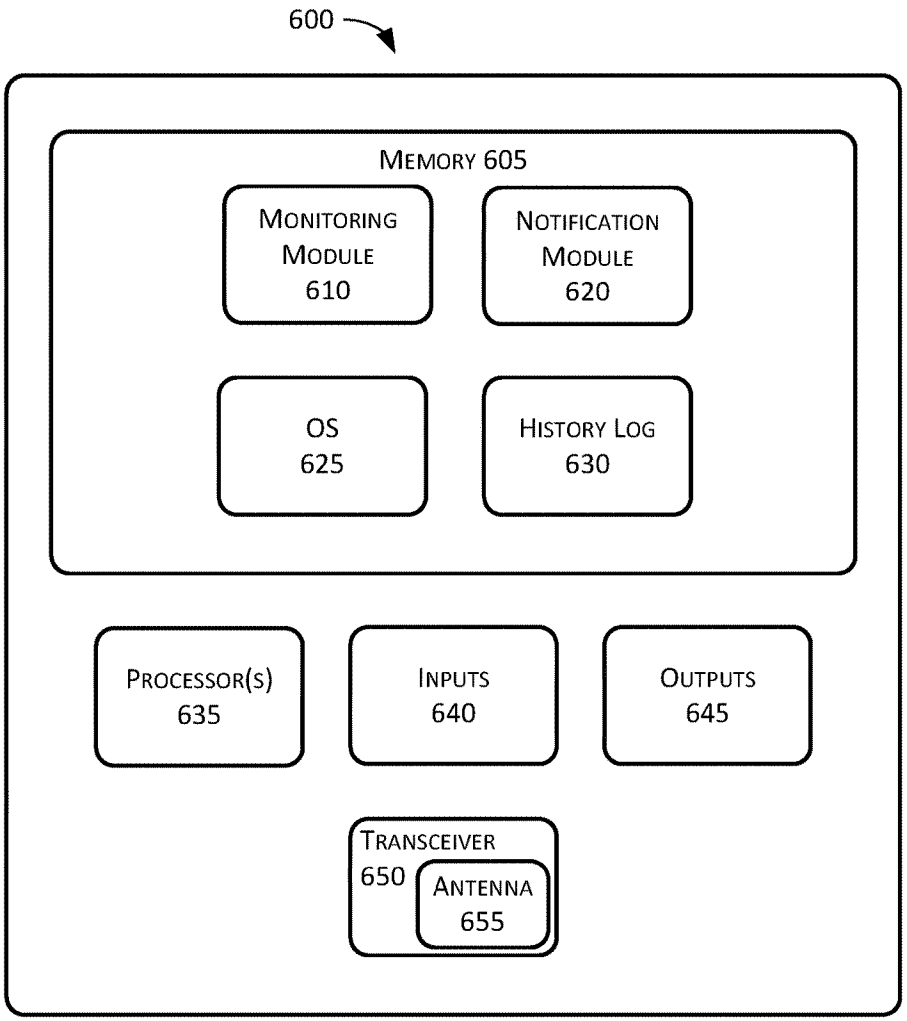
FIG. 6 is a schematic view detailing example components of an example controller for use with a sacrificial anode, in accordance with some examples of the present disclosure.

FIG. 6 depicts an example controller 600 for use with the systems 300, 400 and methods 500 discussed herein. The controller 600 can be an example of a portion of the electronic circuitry 324, the anode controller 415, a combination of both, or a standalone controller. The controller 600 can be a dedicate microcontroller, for example, or can be a general-purpose computer, laptop, tablet, or other device configured to receive the electrical measurements of the sacrificial anode 310, calculate the life of the sacrificial anode 310, send alerts when appropriate, and be reset when maintenance is performed. Indeed, the controller could be a desktop computer with a cellular or WiFi connection to enable the computer to monitor the sacrificial anode 310. The controller 600 can include memory 605, one or more processors 635, one or more inputs 640, one or more outputs 645, and a transceiver 650.

In some examples, the memory 605 can include a number of software modules to enable the controller 600 to monitor the system 300, 400 and alert the user. The memory 605 can include, for example, a monitoring module 610, a notification module 620, an operating system (OS) 625, and a history log 630. As normal, the OS 625 can control the functions of the controller 600 and can include, for example, Windows, Linux, Apple's OS, Arduino, or other suitable OS.

The monitoring module 610 can be in communication with one or both of the controllers 415, 430, for example, or directly in communication with the sacrificial anode 310, and can monitor the degradation status of the sacrificial anode 310. In some examples, the measurement module 610 can be in communication with one or more water detection mechanisms 318, 320, 322, or other suitable sensors that can measure the degradation status of the sacrificial anodes 310. The measurement module 610 can receive water detection information from one or more sensors within the anode 305 (e.g., the one or more water detection mechanisms 318, 320, 322), and determine, based on the water detection information, an anode status. The measurement module 610 can also store data associate with the determined anode status (e.g., times, dates, anode information, etc.) t in the history log 630 to enable the user to monitor trends or detect anomalies (e.g., the anode 310 degrading more rapidly than expected), which can indicate a problem. When the degradation stats of the sacrificial anode 310 reaches a predetermined level, the measurement module 610 can send a signal to the notification module 620.

In some examples, the monitoring module 610 can also act as a diagnostic module. In other words, if the bonding wire 335 breaks, for example, the measurement module 610 can detect a large/rapid change in the electrical properties of the sacrificial anode 310. Similarly, if one of the sensors fails (e.g., one or more water detection mechanisms 318, 320, 322), the measurement module 610 can detect a large/rapid change in the readings for one, or both, of the anodes 310. In the event of a malfunction, as opposed to the erosion of the sacrificial anode 310, for example, the measurement module 610 can send a diagnostic signal instead of the alert. In some examples, regardless of what the fault is with the system 300, 400, the measurement module 610 can send the same diagnostic signal to the notification module 620 (i.e., regardless of the fault, something needs to be repaired or replaced). In other examples, the diagnostic signal be different depending on the detected problem and can also include diagnostic codes.

The notification module 620 can provide alerts and updates on the system 300, 400 condition, including the status of the sacrificial anode 310. In some examples, the notification module 620 can be in communication with the transceiver 650, for example, to send wired, cellular, or WiFi alerts to the user. In some examples, the notification module 620 can provide different messages depending on what signal is received from the measurement module 610 (i.e., anode replacement or malfunction). In other examples, the notification module 620 can be in communication with the one or more outputs 645 and can activate a light or horn, for example, when certain conditions are met. The notification module 620 can light a yellow light emitting diode (LED) when the sacrificial anode 310 reaches a predetermined level (e.g., 10 or 20%), for example, and then light a red LED when the sacrificial anode 310 reaches a second, lower level (e.g., 5 or 10%).

The history log 630 can store determined anode degradation status from the system 300, 400 over time. Depending on how much data is needed or desired, the history log 630 can store data points every few seconds, minutes, hours, days, weeks, etc. In some examples, the number of samples can be based on the corrosion rate of the sacrificial anode 310. In other examples, since it likely requires very little memory or processing power, the number of samples can be very high to provide more granular data. In some examples, the history log 630 can be used to identify trends for diagnostic and maintenance purposes, provide degradation rates and graphs, and/or other useful data.

The controller 600 can also include one or more processors 635. The processors 635 can comprise commercial processors (e.g., AMD® or Intel®), field programmable gate arrays (FPGAs), special purpose chips, etc. and can run the modules 610, 620 and the OS 625 and control the various functions of the controller 600. The processor(s) 635 can receive the inputs 640 and generate the outputs 645 as needed for the controller 600 to monitor the system 300, 400 and alert the user, when needed.

The controller 600 can also include one or more inputs 640. The inputs 640 can include, for example, the one or more water detection mechanisms 318, 320, 322 (or other electronic measurement device(s)) to measure the electrical properties of the anode 310. The inputs 640 can also include a keyboard, mouse, touchscreen, or other device to enable the user to program, reset, and update the controller 600, among other things. In some examples, the inputs 640 can include a reset button to enable the user to reset the system 300, 400 when the sacrificial anode 310 is replaced or the system 300, 400 is repaired.

The controller 600 can also include one or more outputs 645. As discussed above, the controller can include lights, horns, buzzers, etc. (e.g., the alert 470) to provide system 300, 400 status at a glance. The outputs 645 can include green, yellow, and red lights or LEDs, for example, to indicate high, medium, and low anode protection levels, respectively. In some examples, the outputs 645 can also include a screen or a touchscreen to provide a graphical user interface (GUI) that includes system status, protection level, last anode replacement date, projected anode replacement date, and other relevant information.

The controller 600 can also include a transceiver 650. In some examples, the transceiver can include a wired network adapter, such as a local area network (LAN) or wide area network (WAN) adapter to enable the controller 600 to connect to an ethernet, intranet, the Internet, or other communications network. In some examples, the transceiver 650 can comprise a wireless adapter, such as a cellular, WiFi, or Bluetooth® adapter, to enable the controller 600 to connect wirelessly to an intranet, the Internet, or other communications network. In this configuration, the transceiver 650 can include one or more antennas 655. The transceiver 650 can enable the controller 600 to provide system data to an online user portal, for example, or to send data directly to a user's cell phone or tablet or to a specialized maintenance scanner, among other things. Regardless, the transceiver 650 can enable the controller to send and receive data via a wired and/or wireless connection.

While several possible examples are disclosed above, examples of the present disclosure are not so limited. For instance, while the system 300, 400 is discussed above with reference to a pool water heater, the system 300, 400 is equally applicable to other types of systems where fluids are in communication with metallic components and create galvanic corrosion. Thus, the system 300, 400 could be used on all manner of water heaters, heat exchangers, radiators, marine cooling systems, docks, bridges, etc. In addition, while various features are disclosed, other designs could be used. The system 300, 400 is shown with one sacrificial anode 310 having three cavities 312, 314, 316 each having a single water detection mechanisms 318, 320, 322, for example, but could use a higher number of anodes or different number of cavities or water detection mechanisms.

Such changes are intended to be embraced within the scope of this disclosure. The presently disclosed examples, therefore, are considered in all respects to be illustrative and not restrictive. The scope of the disclosure is indicated by any claims filed in a subsequent non-provisional application, rather than the foregoing description, and all changes that come within the meaning and range of equivalents thereof are intended to be embraced therein.

The components of the foregoing example embodiments can be pre-fabricated or specifically generated (e.g., by shaping a malleable body) for a particular heat exchanger, heating system, and/or environment. The components of the example embodiments described herein can have standard or customized features (e.g., shape, size, features on the inner or outer surfaces). Therefore, the example embodiments described herein should not be considered limited to creation or assembly at any particular location and/or by any particular person.

The water heater, the heat exchanger, and the components therein can be made of one or more of a number of suitable materials and/or can be configured in any of a number of ways to allow the water heater and the heat exchanger to meet certain standards and/or regulations while also maintaining reliability of the water heater, regardless of the one or more conditions under which the water heater can be exposed. Examples of such materials can include, but are not limited to, aluminum, stainless steel, ceramic, fiberglass, glass, copper, plastic, zinc, zinc alloy, magnesium, magnesium alloy and/or aluminum for example.

The example components of the water heating devices and heat exchangers described herein can be made from a single piece (e.g., as from a mold, injection mold, die cast, 3-D printing process, extrusion process, stamping process, crimping process, and/or other prototype methods). In addition, or in the alternative, the example components of the water heating devices and heat exchangers described herein can be made from multiple pieces that are mechanically coupled to each other. In such a case, the multiple pieces can be mechanically coupled to each other using one or more of a number of coupling methods, including but not limited to epoxy, welding, fastening devices, compression fittings, mating threads, and slotted fittings. One or more pieces that are mechanically coupled to each other can be coupled to each other in one or more of a number of ways, including but not limited to fixedly, hingedly, removeably, slidably, and threadably.

As used herein, a "coupling feature" can couple, secure, fasten, abut, and/or perform other functions aside from merely coupling. A coupling feature as described herein can allow one or more components of a heat exchanger to become coupled, directly or indirectly, to another portion (e.g., an inner surface) of the heat exchanger. A coupling feature can include, but is not limited to, a snap, a clamp, a portion of a hinge, an aperture, a recessed area, a protrusion, a slot, a spring clip, a tab, a detent, a compression fitting, and mating threads. One portion of an example heat exchanger can be coupled to a component of a heat exchanger and/or another portion of the heat exchanger by the direct use of one or more coupling features.

In addition, or in the alternative, a portion of an example heat exchanger can be coupled to another component of a heat exchanger and/or another portion of the heat exchanger using one or more independent devices that interact with one or more coupling features disposed on a component of the heat exchanger tube. Examples of such devices can include, but are not limited to, a weld, a pin, a hinge, a fastening device (e.g., a bolt, a screw, a rivet), epoxy, adhesive, and a spring. One coupling feature described herein can be the same as, or different than, one or more other coupling features described herein. A complementary coupling feature as described herein can be a coupling feature that mechanically couples, directly or indirectly, with another coupling feature.

Any component described in one or more figures herein can apply to any other figures having the same label. In other words, the description for any component of a figure can be considered substantially the same as the corresponding component described with respect to another figure. For any figure shown and described herein, one or more of the components can be omitted, added, repeated, and/or substituted. Accordingly, embodiments shown in a particular figure should not be considered limited to the specific arrangements of components shown in such figure.

Terms such as "first," "second," "top," "bottom," "left," "right," "end," "back," "front," "side", "length," "width," "inner," "outer," "above", "lower", and "upper" are used merely to distinguish one component (or part of a component or state of a component) from another. Such terms are not meant to denote a preference or a particular orientation unless specified and are not meant to limit embodiments of water heating devices or heat exchangers. In the foregoing detailed description of the example embodiments, numerous specific details are set forth in order to provide a more thorough understanding of the disclosure. However, it will be apparent to one of ordinary skill in the art that the example embodiments can be practiced without these specific details. In other instances, well-known features have not been described in detail to avoid unnecessarily complicating the description.

Accordingly, many modifications and other embodiments set forth herein will come to mind to one skilled in the art to which example water heaters pertain having the benefit of the teachings presented in the foregoing descriptions and the associated drawings. Therefore, it is to be understood that example water heaters are not to be limited to the specific embodiments disclosed and that modifications and other embodiments are intended to be included within the scope of this application. Although specific terms are employed herein, they are used in a generic and descriptive sense only and not for purposes of limitation.

What is claimed is:

1. A sacrificial anode system comprising:

an anode body;

a first cavity within the anode body;

a second cavity within the anode body, the second cavity being concentric with the first cavity;

a first conductor disposed within the first cavity;

a second conductor disposed within the second cavity; and electronic circuitry in communication with the first conductor and the second conductor.

2. The sacrificial anode of claim 1, wherein the electronic circuitry comprises an alert indicator in communication with a power source and with at least one of the first conductor and the second conductor.

3. The sacrificial anode of claim 2, wherein the alert indicator comprises a light emitting diode (LED) assembly in communication with at least one of the first conductor and the second conductor.

4. The sacrificial anode of claim 1, wherein the sacrificial anode is a passive anode.

5. The sacrificial anode of claim 1, wherein the sacrificial anode further comprises an anode housing, wherein the anode body is disposed in the anode housing.

6. The sacrificial anode of claim 5, wherein the anode housing comprises an attachment mechanism configured to connect to a plumbing system.

7. The sacrificial anode of claim 1, wherein the electronic circuitry comprises a timer circuit configured to detect time of operation.

8. The sacrificial anode of claim 1, wherein:

the second cavity has a volume that is smaller than a volume of the first cavity.

9. The sacrificial anode of claim 1, wherein the electronic circuitry comprises a controller configured to:

detect an electrical signal flowing through the first conductor or the second conductor;

generate an alert message; and transmit the alert message to a user device.

10. A water heater system comprising:

a combustion chamber;

an exhaust vent; and a heat exchanger comprising:

a header, and a series of tubes through which water passes, the heat exchanger (i) configured to transfer heat from combustion gases originating in the combustion chamber to the water passing through the series of tubes and (ii) comprising:

an inlet;

an outlet; and a sacrificial anode assembly directly attached to the header, the sacrificial anode assembly comprising:

an anode body, a first cavity within the anode body;

a second cavity within the anode body, the second cavity being concentric with the first cavity;

a first conductor disposed within the first cavity;

a second conductor disposed within the second cavity; and electronic circuitry in communication with the first conductor and the second conductor.

11. The water heater system of claim 10, wherein the sacrificial anode further comprises an anode housing, wherein the anode body is disposed in the anode housing.

12. The water heater system of claim 11, wherein the anode housing comprises an attachment mechanism configured to connect to a portion of the header.

13. The water heater system of claim 10, wherein the anode is a passive anode.

14. The water heater system of claim 10, wherein the electronic circuitry comprises an alert indicator in communication with a power source and with at least one of the first conductor and the second conductor.

15. The water heater system of claim 14, wherein the alert indicator comprises a light emitting diode (LED) assembly in communication with at least one of the first conductor and the second conductor.

16. The water heater system of claim 10, wherein the electronic circuitry includes a timer circuit configured to detect time of operation.

17. A sacrificial anode assembly comprising:

an anode housing configured to attach to a portion of a water heating system and comprising a housing body and a housing cover;

an anode body disposed within the housing body;

a first cavity within the anode body;

a second cavity within the anode body, the second cavity being concentric with the first cavity;

a first water detection mechanism disposed within the first cavity;

a second water detection mechanism disposed within the second cavity; and electronic circuitry in communication with the first water detection mechanism and the second water detection mechanism.

18. The sacrificial anode assembly of claim 17, wherein at least a portion of the electronic circuitry is disposed within the housing cover.

19. The sacrificial anode assembly of claim 17, wherein the electronic circuitry comprises a controller configured to:

detect a signal from the first water detection mechanism or the second water detection mechanism;

determine a degradation status of the anode body;

generate an alert message indicating the degradation status; and transmit the alert message to a user device.

20. The sacrificial anode assembly of claim 17, wherein the electronic circuitry comprises a controller configured to:

detect a signal from the first water detection mechanism or the second water detection mechanism;

determine a degradation status of the anode body;

determine a corrective action based on the degradation status; and output a command signal to a device associated with the water heating system, the command signal including instructions for instituting the corrective action.

* * * * *